US008758032B2

(12) United States Patent
Liang et al.

(10) Patent No.: US 8,758,032 B2
(45) Date of Patent: Jun. 24, 2014

(54) CONNECTOR MECHANISM

(71) Applicant: Wistron Corporation, New Taipei (TW)

(72) Inventors: Chen-Yi Liang, New Taipei (TW); Jiann-Shiun Lin, New Taipei (TW); Cheng-Hsiang Chuang, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 0 days.

(21) Appl. No.: 13/772,349

(22) Filed: Feb. 21, 2013

(65) Prior Publication Data

US 2013/0231010 A1 Sep. 5, 2013

(30) Foreign Application Priority Data

Mar. 1, 2012 (TW) ..... 101106676 A

(51) Int. Cl.
*H01R 13/44* (2006.01)

(52) U.S. Cl.
USPC ..... 439/131; 439/144

(58) Field of Classification Search
USPC ..... 439/131, 138, 142, 144, 166, 170, 217, 439/218, 344, 676
See application file for complete search history.

(56) References Cited

U.S. PATENT DOCUMENTS

| | | | | |
|---|---|---|---|---|
| 5,634,802 | A * | 6/1997 | Kerklaan | 439/131 |
| 7,074,061 | B1 * | 7/2006 | Roth et al. | 439/131 |
| 7,950,936 | B2 * | 5/2011 | Wang et al. | 439/144 |
| 8,337,222 | B2 * | 12/2012 | Hung et al. | 439/138 |
| 2010/0248554 | A1 | 9/2010 | Hung | |
| 2013/0034979 | A1 * | 2/2013 | Chang et al. | 439/131 |

* cited by examiner

*Primary Examiner* — Felix O Figueroa
(74) *Attorney, Agent, or Firm* — Winston Hsu; Scott Margo

(57) ABSTRACT

A connector mechanism includes a first casing, a second casing, a rotary cover, a circuit board, a socket, a base, a rotary fastener and a resilient component. The rotary cover is connected to the second casing in a rotable manner. The rotary fastener is pivoted to the base. The rotary fastener is pressed by the rotary cover when the rotary cover rotates to a close position. The rotary fastener fastens a plug when the rotary cover rotates to an open position so as not to press the rotary fastener and when the plug is inserted into the socket. The resilient component is connected to the rotary fastener for driving the rotary fastener to fasten the plug when the rotary cover rotates to the open position.

13 Claims, 10 Drawing Sheets

CONNECTOR MECHANISM

BACKGROUND OF THE INVENTION

1. Field of the Invention

The present invention relates to a connector mechanism, and more particularly, to a connector mechanism with reduced structural height thereof.

2. Description of the Prior Art

With the development of information and computer technology, the size of a computer is becoming smaller and the computer is utilized in a wide variety of fields. In order to expand functions of a computer system for satisfying user's various demands, various external devices of the computer system come with the trend. For example, an external hard disk drive and a portable storage device can expand the memory capacity of the computer system. An external optical disk drive and an optical disk writer can expand multimedia access function of the computer system. A network cable allows the computer system to be connected to an internet so as to gather information online or surf webpage. However, with the trend for the notebook computer to be thinner, it brings more challenges for mechanical design. Connecting ports disposed on a side of the notebook computer will constrain the thickness of mechanism of the notebook computer. For example, an Ethernet port, such as a RJ 45 port for connecting to network or RJ11 port for connecting a telephone cable, has a fixed size of the opening. Accordingly, a thickness of the notebook computer needs to be increased in order to match the size of the connecting ports. Alternatively, the network port or the telephone port is designed to be exposed out of the notebook computer, so as to affect an aesthetic feeling of appearance. In order to solve the above drawbacks, US patent of publication no. 20100248554 discloses a mechanism with a rotary cover for adjusting the size of the opening. However, a shaft of the aforesaid rotary cover is easily to be applied by a shear force, so as to break the shaft of the rotary cover. Thus, mechanisms designed for satisfying height specification, having less components and good structural strength as well as meeting trends for thin design without sacrificing the aesthetic feeling of appearance have been issues of mechanical design of the connector mechanism in the electronic field.

SUMMARY OF THE INVENTION

The present invention provides a connector mechanism with reduced structural height thereof for solving above drawbacks.

According to the claimed invention, a connector includes a first casing, a second casing, a rotary cover, a circuit board, a socket, abase, a rotary fastener and a resilient component. The second casing is combined with the first casing, and an opening slot is formed on the second casing. The rotary cover is connected to the second casing in a rotable manner and located within the opening slot. The circuit board is installed between the first casing and the second casing. The socket is coupled to the circuit board and disposed on the first casing in a position corresponding to the opening slot. The base is installed on the circuit board and located on a side of the socket. The rotary fastener is pivoted to the base. The rotary fastener is pressed by the rotary cover when the rotary cover rotates to a close position, and the rotary fastener fastens a plug when the rotary cover rotates to an open position so as not to press the rotary fastener and when the plug is inserted into the socket. The resilient component is connected to the rotary fastener for driving the rotary fastener to fasten the plug when the rotary cover rotates to the open position.

According to the claimed invention, the first casing includes at least one wedging hole portion, and the rotary cover includes at least one hook portion for hooking the at least one wedging hole portion when the rotary cover rotates to the close position.

According to the claimed invention, the second casing includes a constraining portion disposed on a side of the opening slot for constraining rotation of the rotary cover.

According to the claimed invention, the rotary fastener includes a fastening portion for fastening a fastening structure on the plug when the plug is inserted into the socket.

According to the claimed invention, the rotary fastener includes a stopper, and the base includes at least one protrusion for stopping the stopper of the rotary fastener, so as to constrain rotation of the rotary fastener.

According to the claimed invention, at least one hole is formed on the base, and the rotary fastener includes at least one shaft disposed in the at least one hole in a rotable manner, so as to pivot the rotary fastener to the base.

According to the claimed invention, an inclined plane is formed on the base and located on a side of the at least hole for guiding the shaft of the rotary fastener to be installed into the at least one hole.

According to the claimed invention, the resilient component sheathes the at least one shaft, and the rotary fastener further includes a hook for hooking an end of the resilient component.

According to the claimed invention, the base includes at least one constraining block located on at least one side of another end of the resilient component for constraining axial movement of the resilient component relative to the shaft.

According to the claimed invention, an inclined structure is formed on an end of the resilient component for guiding pressing movement of the rotary cover, such that the rotary fastener pivots relative to the base.

According to the claimed invention, an opening is formed on a side of the rotary cover, and the rotary fastener fastens the plug for preventing the plug from separating from the opening when the rotary cover rotates to the open position so as not to press the rotary fastener and when the plug is inserted into the socket via the opening.

In summary, the connector mechanism of the present invention utilizes the rotary cover for adjusting the height of the opening adapted to the plug and further utilizes the rotary fastener for fixing the plug inserted into the socket, so as to allow the connector mechanism to couple to the external plug with larger size. The connector mechanism neither needs to increase structural height of the electronic device nor needs to adopt a design to dispose a partially protrusion. Accordingly, it can keep aesthetic feeling of appearance. As a result, the connector mechanism of the present invention can satisfy height specification, have less components and good structural strength as well as meet trends for thin design without sacrificing the aesthetic feeling of appearance.

These and other objectives of the present invention will no doubt become obvious to those of ordinary skill in the art after reading the following detailed description of the embodiment that is illustrated in the various figures and drawings.

DETAILED DESCRIPTION

In the following detailed description of the embodiments, reference is made to the accompanying drawings which form a part hereof, and in which is shown by way of illustration specific embodiments in which the invention may be practiced. In this regard, directional terminology, such as "top," "bottom," etc., is used with reference to the orientation of the Figure(s) being described. The components of the present invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," and "installed" and variations thereof herein are used broadly and encompass direct and indirect connections and installations. Accordingly, the drawings and descriptions will be regarded as illustrative in nature and not as restrictive.

Figure 1:
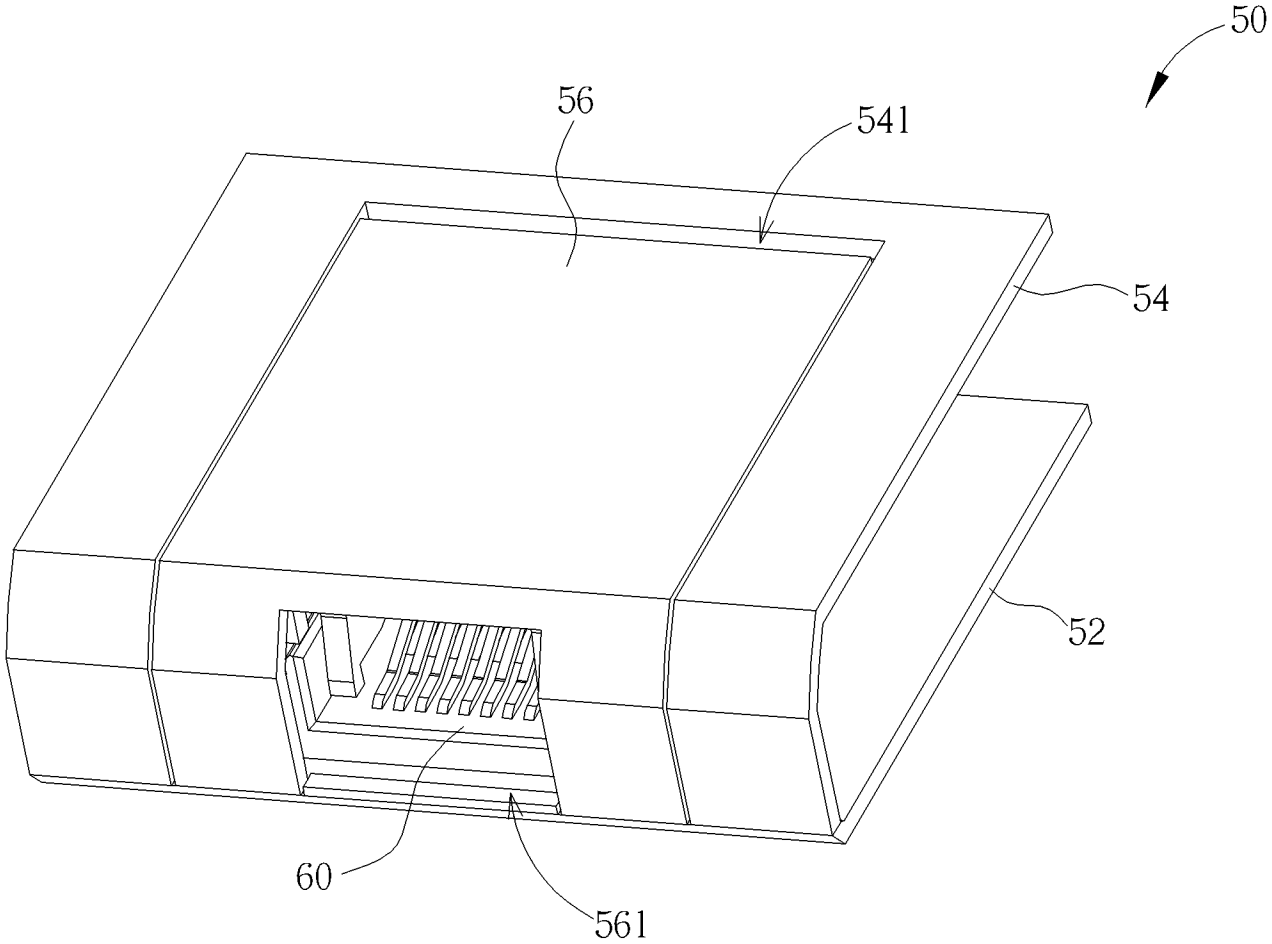
FIG. 1 and FIG. 2 are respectively schematic diagrams of a connector mechanism in different statuses according to an embodiment of the present invention.
Figure 2:
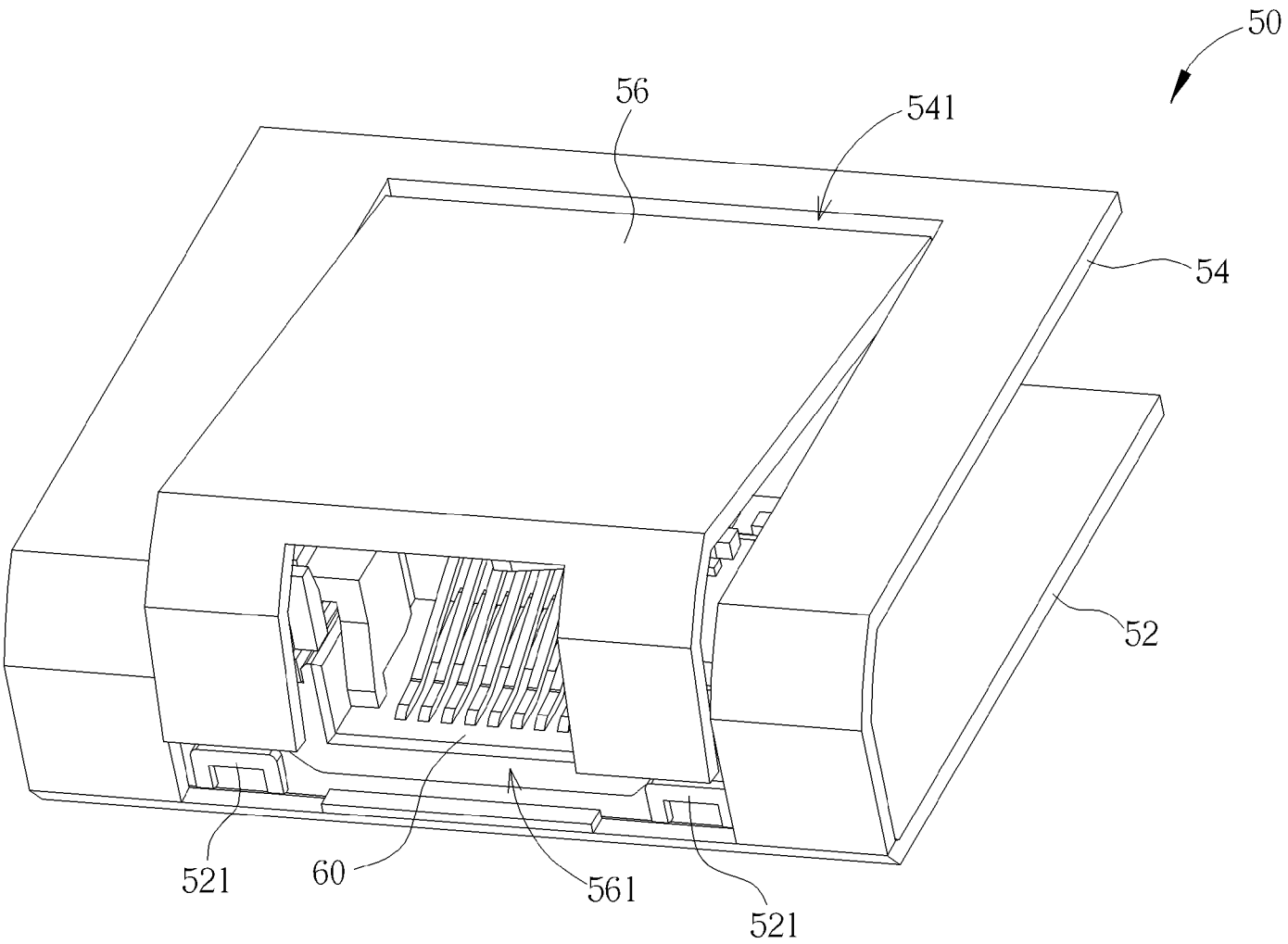
Figure 3:
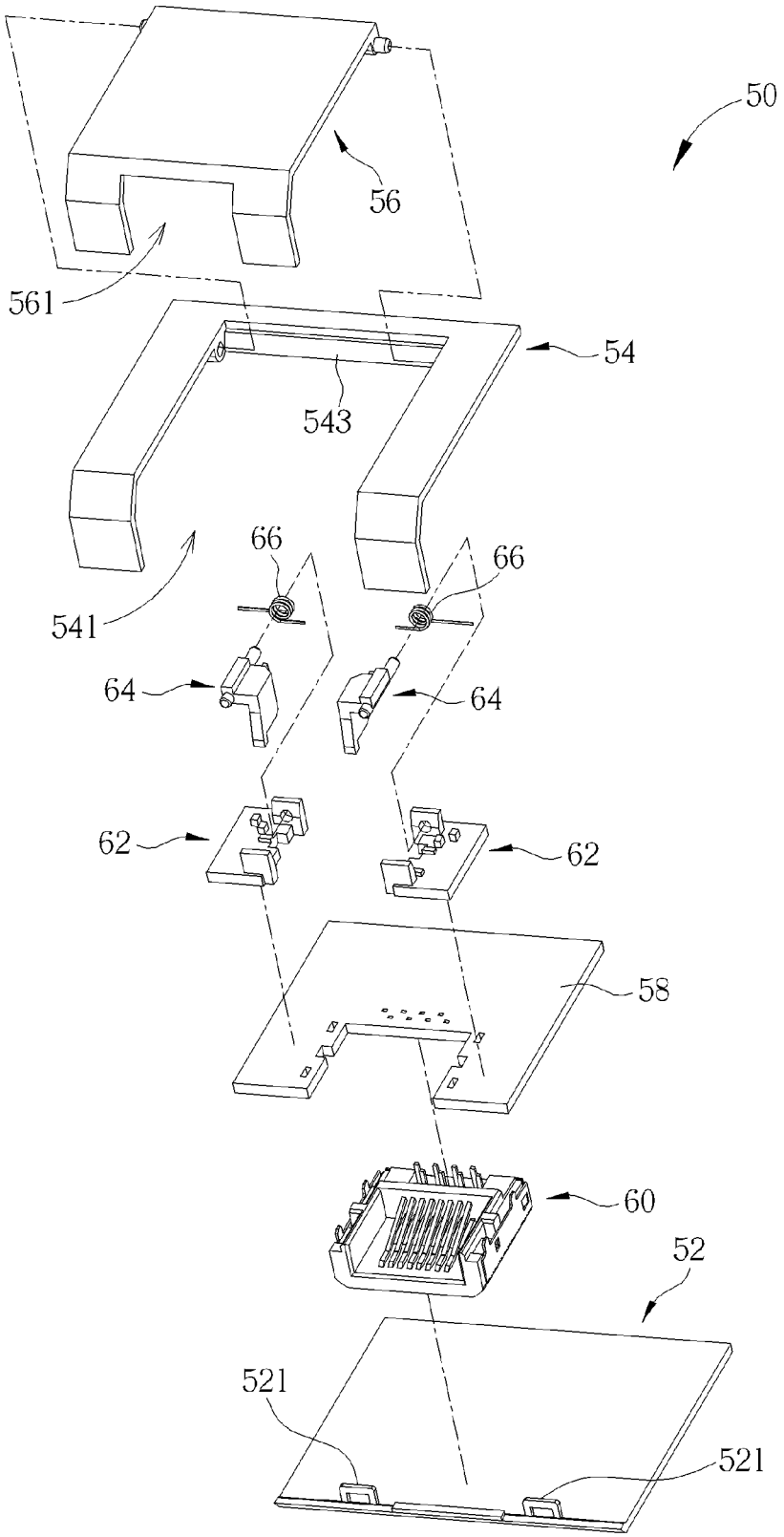
FIG. 3 is an exploded diagram of the connector mechanism according to the embodiment of the present invention.
Figure 4:
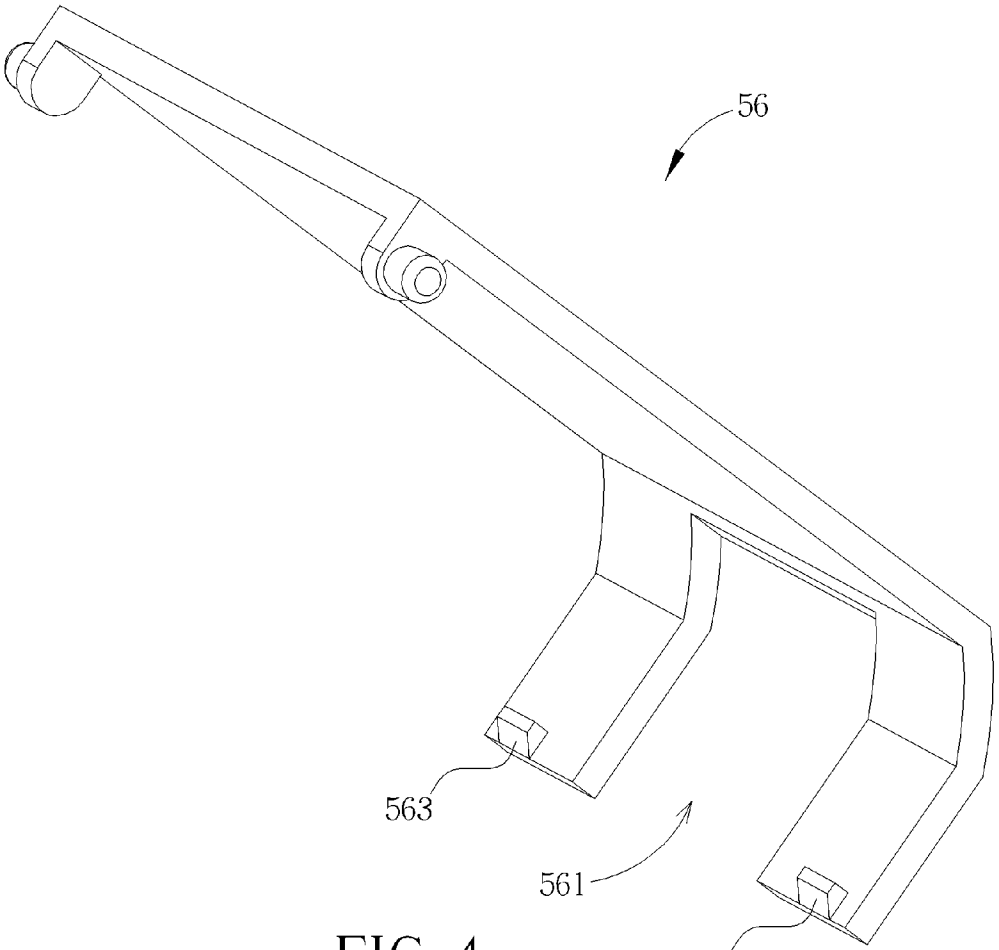
FIG. 4 is a diagram of a rotary cover according to the embodiment of the present invention.

Please refer to FIG. 1 to FIG. 3. FIG. 1 and FIG. 2 are respectively schematic diagrams of a connector mechanism 50 in different statuses according to an embodiment of the present invention. FIG. 3 is an exploded diagram of the connector mechanism 50 according to the embodiment of the present invention. The connector mechanism 50 includes a first casing 52 and a second casing 54. The second casing is combined with the first casing 52 for covering internal components, cooperatively. The first casing 52 includes at least one wedging hole portion 521. In this embodiment, the first casing 52 includes two wedging hole portions 521. An amount and disposal positions of the wedging hole portion 521 are not limited to those mentioned in this embodiment, and it depends on practical demands. An opening slot 541 is formed on the second casing 54. Furthermore, the first casing 52 and the second casing 54 can be an upper casing and a lower casing of an electronic device, respectively. The connector mechanism 50 further includes a rotary cover 56 connected to the second casing 54 in a rotable manner and located within the opening slot 541. For example, the rotary cover 56 can utilizes shafts disposed on two sides thereof to be respectively pivoted to pivotal holes on the second casing 54. Furthermore, the second casing 54 includes a constraining portion 543 disposed on a side of the opening slot 541 for constraining rotation of the rotary cover 56. Thus, the constraining portion 543 can prevent the rotary cover 56 from over rotation so as not to expose the internal components. Accordingly, it can keep aesthetic feeling of appearance and prevent the internal components from an electrostatic discharge. Please refer to FIG. 4. FIG. 4 is a diagram of the rotary cover 56 according to the embodiment of the present invention. An opening 561 is formed on a side of the rotary cover 56, and the rotary cover 56 includes at least one hook portion 563. The at least one hook portion 563 is used for hooking the corresponding wedging hole portion 521 of the first casing 52 when the rotary cover 56 rotates to a close position shown in FIG. 1, so as to fix the rotary cover 56. In this embodiment, the rotary cover 56 includes two hook portions 563 which are respectively located in positions corresponding to the two wedging hole portions 521. An amount and disposal positions of the hook portion 563 are not limited to those mentioned in this embodiment, and it depends on practical demands.

Figure 5:
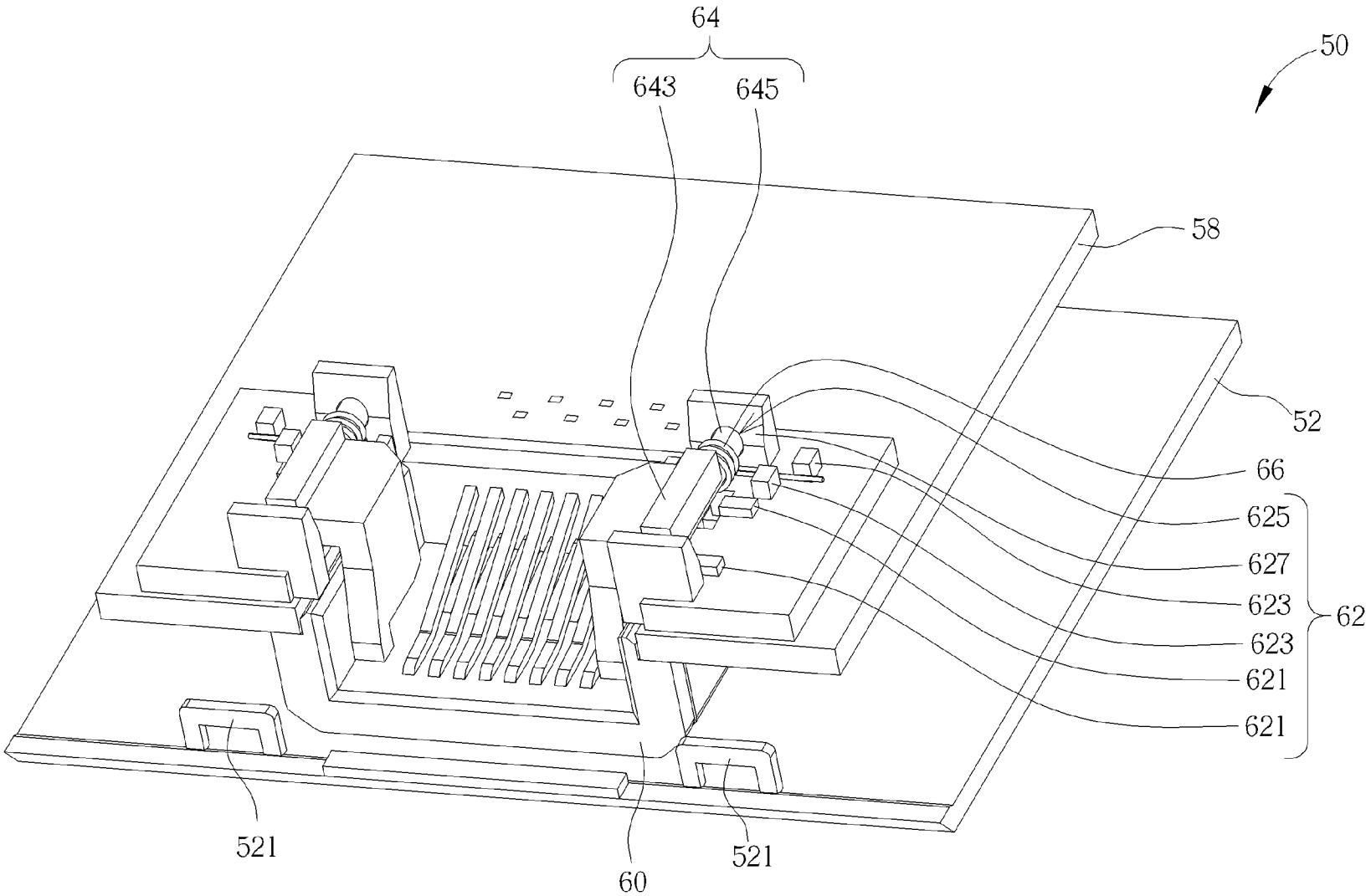
FIG. 5 and FIG. 6 are respectively internal diagrams of the connector mechanism corresponding to FIG. 1 and FIG. 2 according to the embodiment of the present invention.
Figure 6:
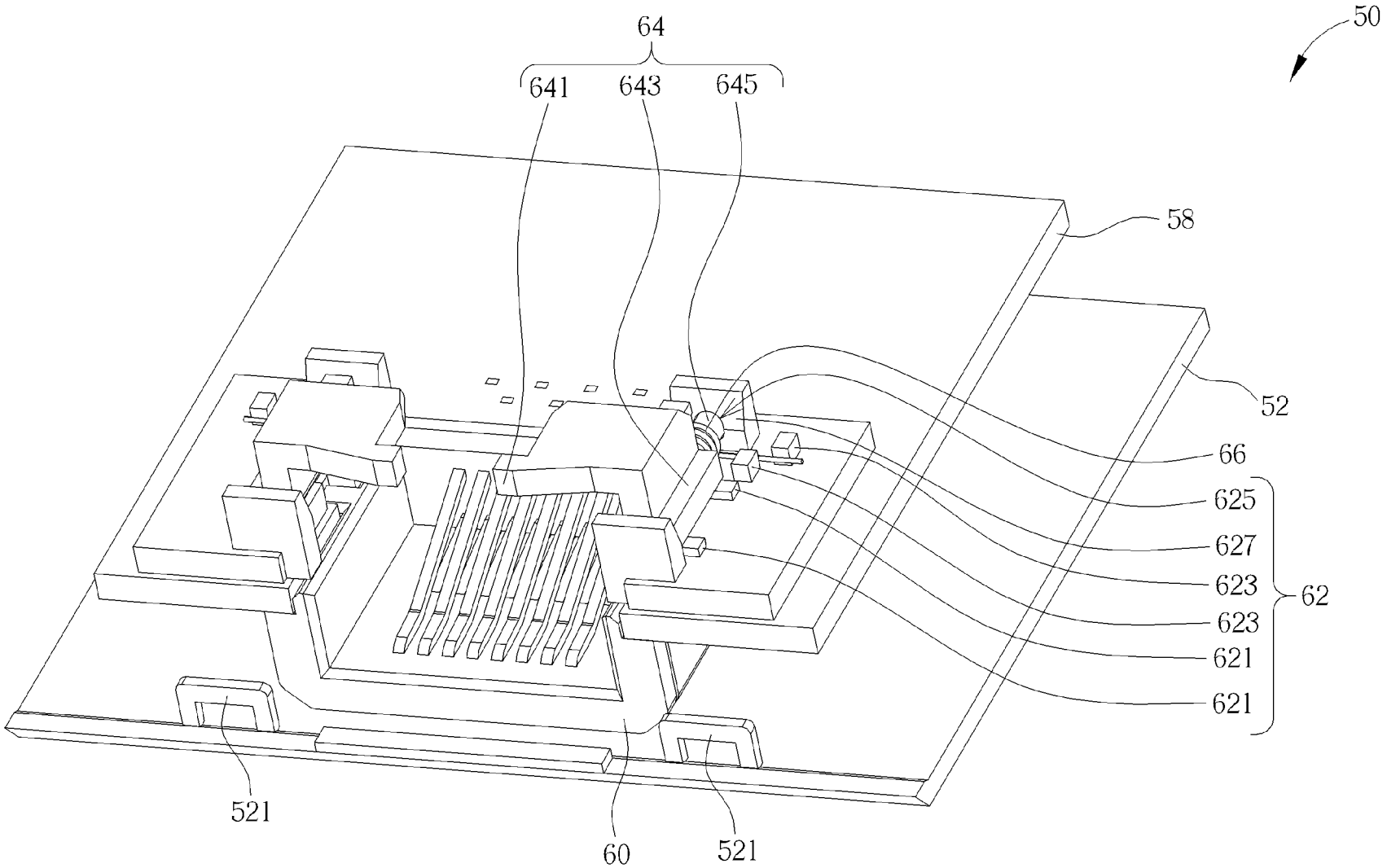

The connector mechanism 50 further includes a circuit board 58 and a socket 60. The circuit board 58 is installed between the first casing 52 and the second casing 54. The socket 60 is coupled to the circuit board 58 and disposed on the first casing 52 in a position corresponding to the opening slot 541. Please refer to FIG. 1 to FIG. 3 and refer to FIG. 5 and FIG. 6. FIG. 5 and FIG. 6 are respectively internal diagrams of the connector mechanism 50 corresponding to FIG. 1 and FIG. 2 according to the embodiment of the present invention. It should be noticed that the second casing 54 and the rotary cover 56 are omitted in FIG. 5 and FIG. 6 for clearly illustrating internal structures of the connector mechanism 50. The connector mechanism 50 further includes at least one base 62, at least one rotary fastener 64 and at least one resilient component 66. In this embodiment, the connector mechanism 50 includes two sets of the base 62, the rotary fastener 64 and the resilient component 66, which are respectively disposed on two sides of the socket 60. Amounts and disposal positions of the base 62, the rotary fastener 64 and the resilient component 66 are not limited to those mentioned in this embodiment, and it depends on practical demands. Since structures and principles of the two sets of the base 62, the rotary fastener 64 and the resilient component 66 are identical to each other, the structures and the principles are illustrated for one of the two sets of the base 62, the rotary fastener 64 and the resilient component 66 and omitted for the other one of the two sets of the base 62, the rotary fastener 64 and the resilient component 66 hereinafter.

Figure 7:
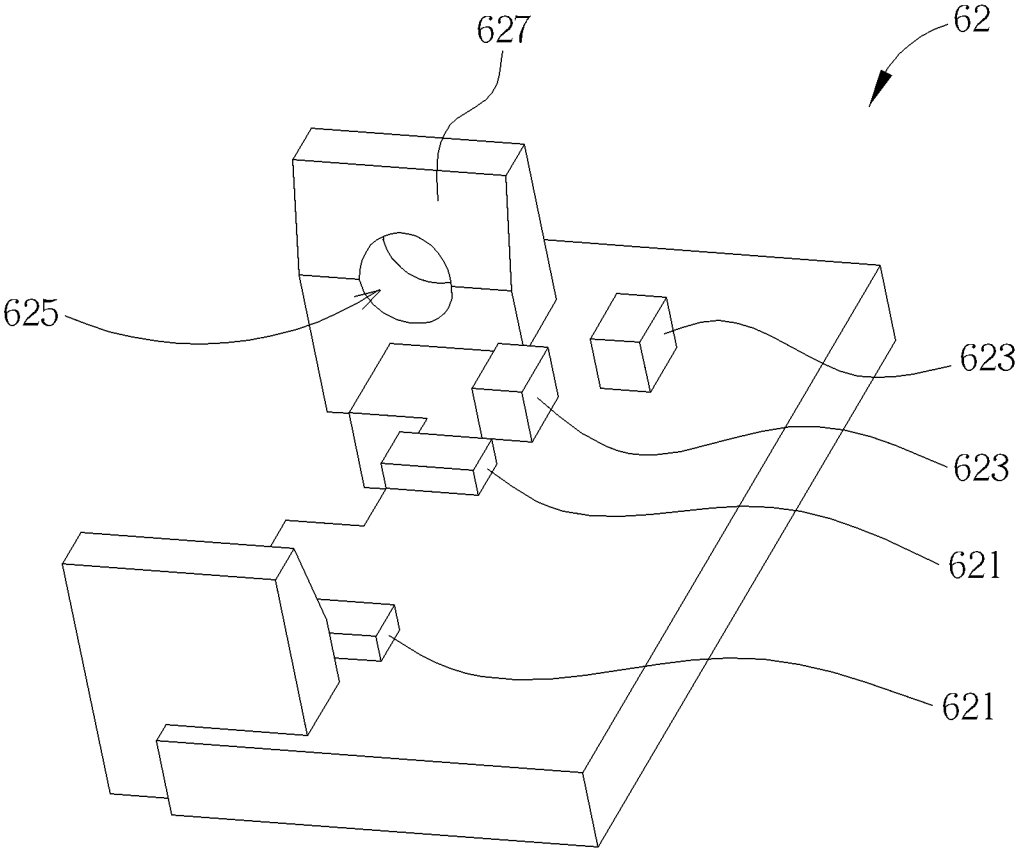
FIG. 7 is a diagram of a base according to the embodiment of the present invention.
Figure 8:
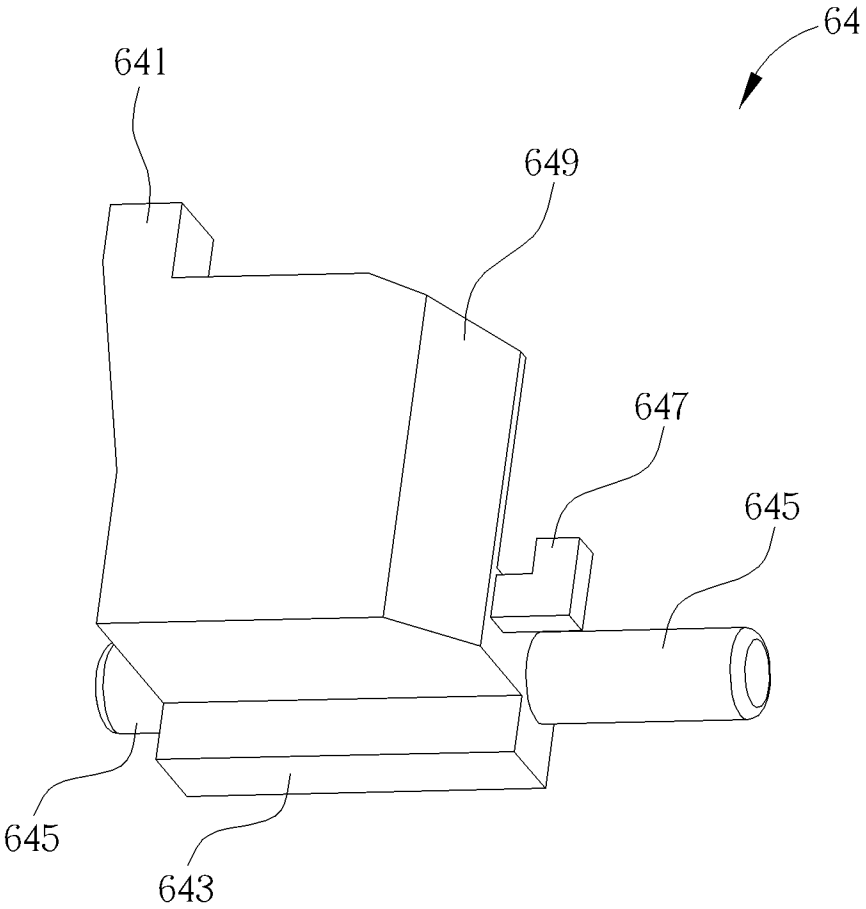
FIG. 8 is a diagram of a rotary fastener according to the embodiment of the present invention.

Please refer to FIG. 7. FIG. 7 is a diagram of the base 62 according to the embodiment of the present invention. The base 62 is installed on the circuit board 58 and located on a side of the socket 60. Each of the base 62 includes at least one protrusion 621 and at least one constraining block 623, and at least one hole 625 is formed on the base 62, which can be a blind hole or a through hole. An inclined plane 627 is formed on the base 62 and located on a side of each of the hole 625. In this embodiment, the base 62 includes two protrusions 621, two constraining blocks 623 and two holes 625. Amounts and disposal positions of the protrusion 621, the constraining block 623 and the hole 625 are not limited to those mentioned in this embodiment, and it depends on practical demands. Please refer to FIG. 8. FIG. 8 is a diagram of the rotary fastener 64 according to the embodiment of the present invention. The rotary fastener 64 is pivoted to the base 62. The rotary fastener 64 includes a fastening portion 641, a stopper 643, at least one shaft 645, a hook 647 and an inclined structure 649. The shaft 645 is disposed in the corresponding hole 625 on the base 62 in a rotable manner, so as to pivot the rotary fastener 64 to the base 62. Furthermore, the shaft 645 is forced by an axial force instead of a shear force. The inclined plane 627 on the side of the hole 625 can guide the shaft 645 of the rotary fastener 64 to be installed into the corresponding hole 625. The resilient component 66 can be a torsion spring sheathing on the shaft 645. The hook 647 of the rotary fastener 64 is used for hooking an end of the resilient component 66, and the two constraining blocks 623 of the base 62 are respectively disposed on two sides of another end of the resilient component 66, so as to constrain axial movement of the resilient component 66 relative to the shaft 645. In other words, the two constraining blocks 623 are used for preventing the resilient component 66 from moving along an axis of the shaft 645. Accordingly, the resilient component 66 can be fixed by the hook 647 and the constraining blocks 623, such that the resilient component 66 applies an torque on the base 62 for pivoting the rotary fastener 64 relative to the base 62.

When the connector mechanism 50 is not coupled to an external plug, i.e. the connector mechanism 50 is in an initial status, as shown in FIG. 1 and FIG. 5, the rotary cover 56 is rotated to the close position and hooked with the corresponding wedging hole portion 521 of the first casing 52 by the hook portion 563 of the rotary cover 56, so as to fix the rotary cover 56. In the meanwhile, the rotary cover 56 presses the rotary fastener 64. Since there is the inclined structure 649 formed on an end of the rotary fastener 64, the inclined structure 649 can be guiding pressing movement of the rotary cover 56, such that the rotary fastener 64 pivots relative to the base 62 to a position shown in FIG. 5, i.e. a position where the rotary fastener 64 is substantially perpendicular to the first casing 52. During the aforesaid process, the resilient component 66 is in forced to be deformed. If the connector mechanism 50 is desired to be coupled to the external plug, the hook portion 563 of the rotary cover 56 can be released from the wedging hole portion 521 of the first casing 52. In the meanwhile, since the rotary cover 56 no longer presses the rotary fastener 64 gradually, the resilient component 66 provides the rotary fastener 64 with a resilient force, so as to pivot the rotary fastener 64 relative to the base 62 upward to a position shown in FIG. 6, i.e. a position where the rotary fastener 64 is substantially parallel to the first casing 52.

Figure 9:
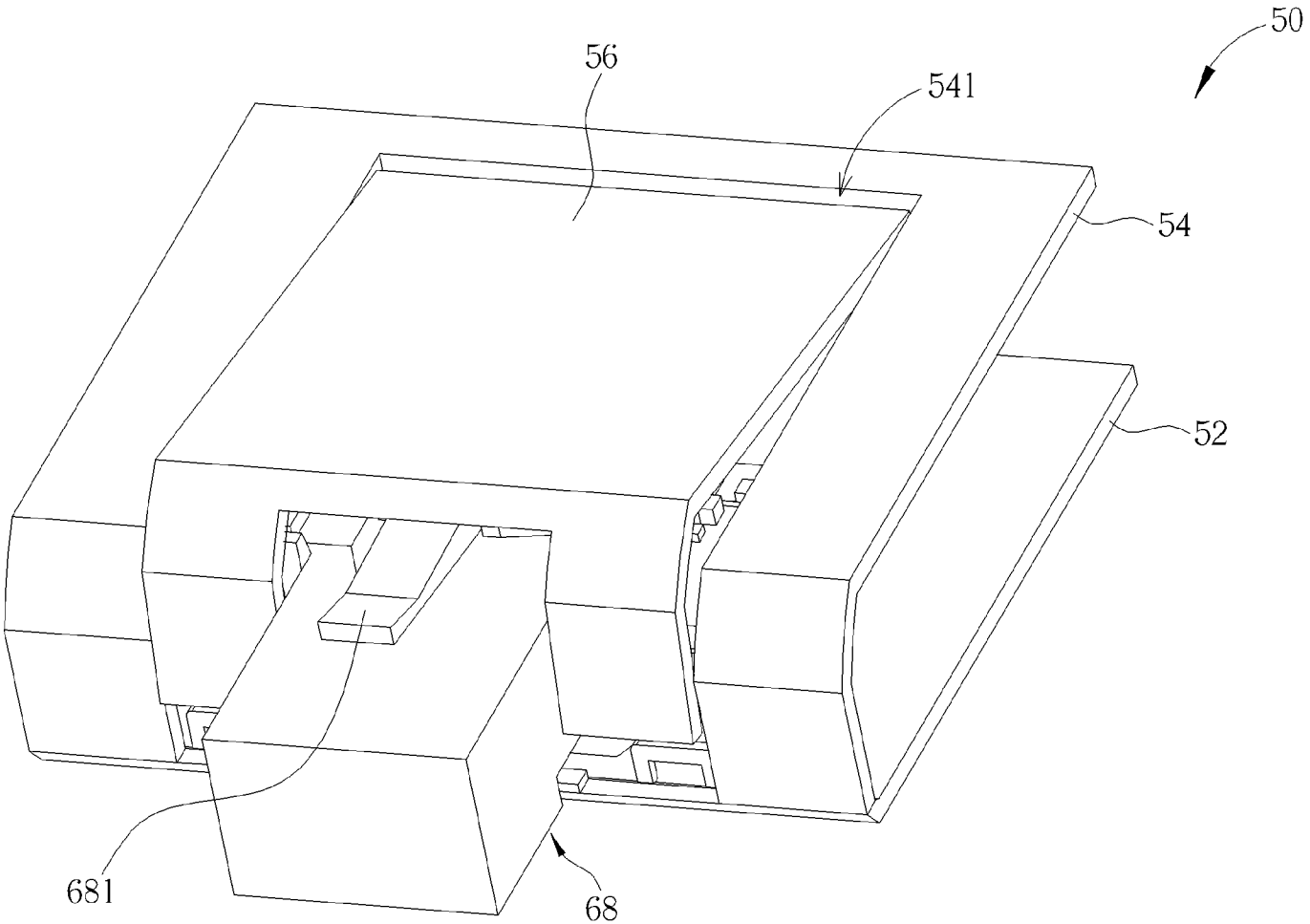
FIG. 9 and FIG. 10 are respectively a schematic diagram and an internal diagram illustrating that the connector mechanism is coupled to a plug according to the embodiment of the present invention.
Figure 10:
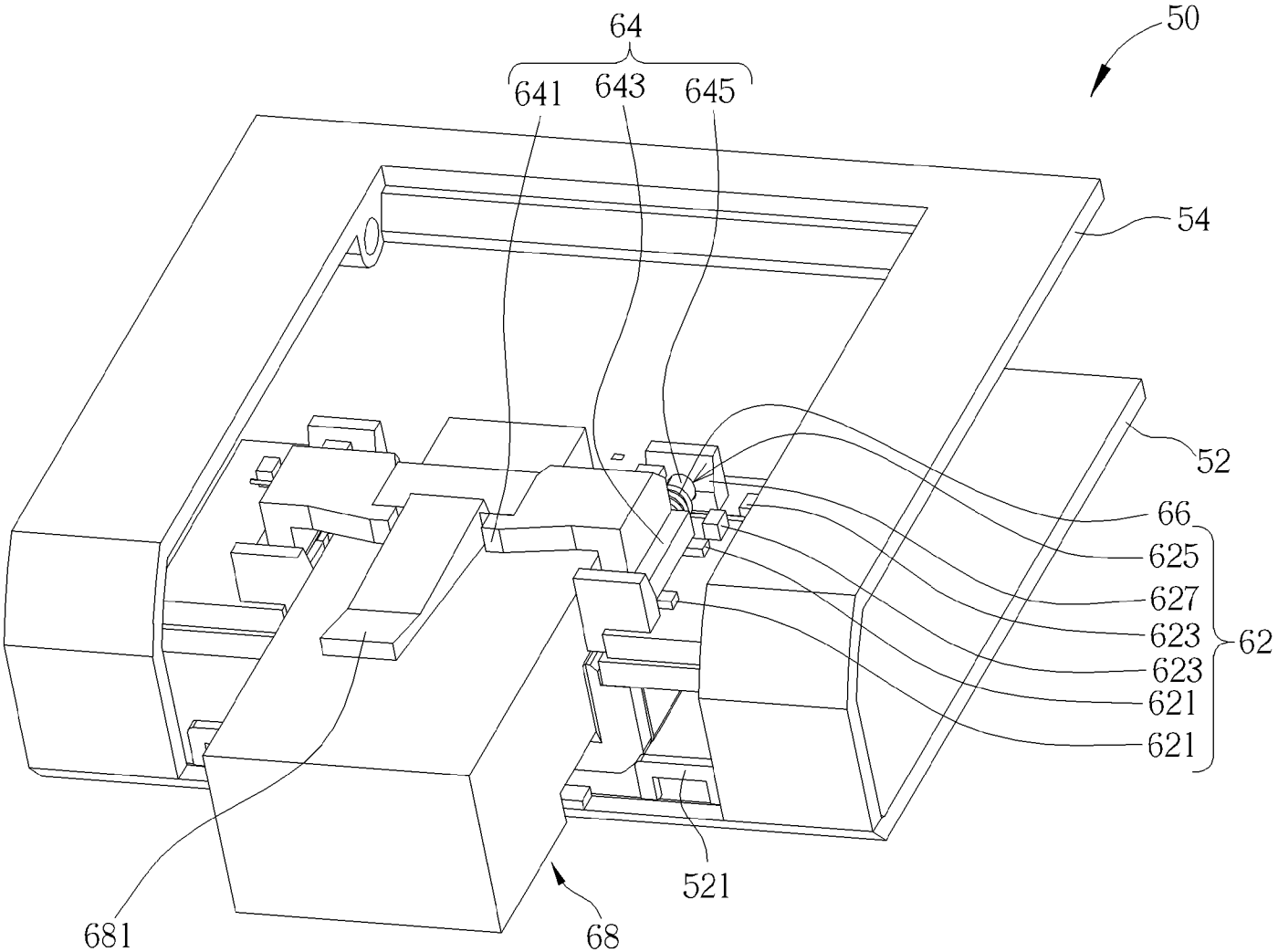

Please refer to FIG. 9 and FIG. 10. FIG. 9 and FIG. 10 are respectively a schematic diagram and an internal diagram illustrating that the connector mechanism 50 is coupled to a plug 68 according to the embodiment of the present invention. In order to clearly illustrate internal structures of the connector mechanism 50, the rotary cover 56 is omitted in FIG. 10. When the hook portion 563 of the rotary cover 56 is not engaged with the wedging hole portion 521 of the first casing 52 and when the plug 68 is disposed in the opening 561, the plug 68 will push the rotary cover 56 upwards. In the meanwhile, the resilient component 66 can drive the rotary fastener 64 to pivot upwards, such that the rotary fastener 64 drives the rotary cover 56 to be opened. Alternatively, a user can rotate the rotary cover 56 to an open position shown in FIG. 2 and FIG. 9, such that a height of the opening 561 on the rotary cover 56 is greater than a height of the opening 561 on the rotary cover 56 shown in FIG. 1. In the meanwhile, the plug 68 with the size greater than the height of the opening 561 shown in FIG. 1 can successfully pass the opening 561 for being inserted between the rotary cover 56 and the first casing 52, and the plug 68 contacts the socket 60 for coupling the plug 68 and the circuit board 58. Additionally, the rotary cover 56 of the present invention can not dispose an opening and implement a design that the rotary cover 56 is manually rotated by the user to the open position instead. As for which one of the above-mentioned designs is adopted, it depends on practical demands. The plug 68 can be an Ethernet connector, such as a RJ 45 connector, or a modem connector, such as a RJ11 connector. In other words, the connector mechanism 50 can be an Ethernet connector mechanism or a modem connector mechanism. In addition, when the rotary cover 56 no longer presses the rotary fastener 64, the resilient component 66 can drive the rotary fastener 64 to pivot upwards relative to the base 62. The protrusion 621 of the base 62 can stop the stopper 643 of the rotary fastener 64 for constraining rotation of the rotary cover 56, so as to ensure the angle of the rotary fastener 64 desired to be hold. Furthermore, after the user press a fastening structure 681 of the plug 68 for inserting the plug 68 into the socket 60, the fastening structure 681 of the plug 68 can be released for recovering the fastening structure 681 to a recovering status. In the meanwhile, the fastening portion 641 of the rotary fastener 64 can fasten the fastening structure 681 of the plug 68 for preventing the rotary fastener 64 from separating from the opening 561. Accordingly, the plug 68 can be firmly fixed inside the connector mechanism 50. Conversely, when the plug 68 is desired to be unplugged, the user can press the fastening structure 681 of the plug 68 again. In the meanwhile, the fastening portion 641 of the rotary fastener 64 can no longer fasten the fastening structure 681 of the plug 68. Accordingly, the plug 68 can be pulled out from the connector mechanism 50.

As known above, when the rotary cover 56 rotates to the close position shown in FIG. 1, the height of the opening 561 can not allow the plug 68 to be inserted in the socket 60. When the rotary cover 56 rotates to the open position shown in FIG. 2, i.e. the resilient component 66 drives the rotary fastener 64 and the rotary cover 56 to rotate upwards for increasing a distance between the rotary cover 56 and the first casing 52, so as to increase the height of the opening 561, the plug 68 can be smoothly inserted in the socket 60. When the connector mechanism 50 is done with using and does not need to be coupled to the plug 68, the plug 68 can be pulled out in advance, and then the rotary cover 56 is rotated to the close position. Afterwards, the hook portion 563 of the rotary cover 56 is hooked the corresponding wedging hole portion 521 of the first casing 52 for fixing the rotary cover 56.

Compared to the prior art, the connector mechanism of the present invention utilizes the rotary cover for adjusting the height of the opening adapted to the plug and further utilizes the rotary fastener for fixing the plug inserted into the socket, so as to allow the connector mechanism to couple to the external plug with larger size. The connector mechanism neither needs to increase structural height of the electronic device nor needs to adopt a design to dispose a partially protrusion. Accordingly, it can keep aesthetic feeling of appearance. As a result, the connector mechanism of the present invention can satisfy height specification, have less components and good structural strength as well as meet trends for thin design without sacrificing the aesthetic feeling of appearance.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A connector mechanism comprising:

a first casing;

a second casing combined with the first casing, an opening slot being formed on the second casing;

a rotary cover connected to the second casing in a rotable manner and located within the opening slot;

a circuit board installed between the first casing and the second casing;

a socket coupled to the circuit board and disposed on the first casing in a position corresponding to the opening slot;

a base installed on the circuit board and located on a side of the socket;

a rotary fastener pivoted to the base, the rotary fastener being pressed by the rotary cover when the rotary cover rotates to a close position, the rotary fastener fastening a plug when the rotary cover rotates to an open position so as not to press the rotary fastener and when the plug is inserted into the socket; and a resilient component connected to the rotary fastener for driving the rotary fastener to fasten the plug when the rotary cover rotates to the open position.

2. The connector mechanism of claim 1, wherein the first casing comprises at least one wedging hole portion, and the rotary cover comprises at least one hook portion for hooking the at least one wedging hole portion when the rotary cover rotates to the close position.

3. The connector mechanism of claim 1, wherein the second casing comprises a constraining portion disposed on a side of the opening slot for constraining rotation of the rotary cover.

4. The connector mechanism of claim 2, wherein the second casing comprises a constraining portion disposed on a side of the opening slot for constraining rotation of the rotary cover.

5. The connector mechanism of claim 1, wherein the rotary fastener comprises a fastening portion for fastening a fastening structure on the plug when the plug is inserted into the socket.

6. The connector mechanism of claim 1, wherein the rotary fastener comprises a stopper, and the base comprises at least one protrusion for stopping the stopper of the rotary fastener, so as to constrain rotation of the rotary fastener.

7. The connector mechanism of claim 5, wherein the rotary fastener comprises a stopper, and the base comprises at least one protrusion for stopping the stopper of the rotary fastener, so as to constrain rotation of the rotary fastener.

8. The connector mechanism of claim 1, wherein at least one hole is formed on the base, and the rotary fastener comprises at least one shaft disposed in the at least one hole in a rotable manner, so as to pivot the rotary fastener to the base.

9. The connector mechanism of claim 8, wherein an inclined plane is formed on the base and located on a side of the at least hole for guiding the shaft of the rotary fastener to be installed into the at least one hole.

10. The connector mechanism of claim 8, wherein the resilient component sheathes the at least one shaft, and the rotary fastener further comprises a hook for hooking an end of the resilient component.

11. The connector mechanism of claim 10, wherein the base comprises at least one constraining block located on at least one side of another end of the resilient component for constraining axial movement of the resilient component relative to the shaft.

12. The connector mechanism of claim 1, wherein an inclined structure is formed on an end of the resilient component for guiding pressing movement of the rotary cover, such that the rotary fastener pivots relative to the base.

13. The connector mechanism of claim 1, wherein an opening is formed on a side of the rotary cover, and the rotary fastener fastening the plug for preventing the plug from separating from the opening when the rotary cover rotates to the open position so as not to press the rotary fastener and when the plug is inserted into the socket via the opening.

* * * * *